US006088301A

United States Patent [19]

Tsuji

[11] Patent Number: 6,088,301

[45] Date of Patent: Jul. 11, 2000

[54] ELECTRONIC TIMEPIECE

[75] Inventor: Tomoharu Tsuji, Chiba, Japan

[73] Assignee: Seiko Instruments Inc., Japan

[21] Appl. No.: 09/249,268

[22] Filed: Feb. 12, 1999

[30] Foreign Application Priority Data

Feb. 19, 1998 [JP] Japan ..... 10-031514

[51] Int. Cl.[7] ..... G04B 19/24

[52] U.S. Cl. ..... 368/28; 368/37

[58] Field of Search ..... 368/28, 31–37

[56] References Cited

U.S. PATENT DOCUMENTS

| | | | |
|---|---|---|---|
| 4,060,977 | 12/1977 | Rochat | 368/35 |
| 4,282,592 | 8/1981 | Miyasaka | 368/37 |
| 4,320,476 | 3/1982 | Berney | 368/28 |
| 5,903,519 | 5/1999 | Takahashi et al. | 368/35 |

*Primary Examiner*—Vit Miska

*Attorney, Agent, or Firm*—Adams & Wilks

[57] ABSTRACT

A timepiece has a gear train having a plurality of intermeshed gears including a 24 o'clock wheel. To avoid error, the phase angle of the 24 o'clock wheel at which a given detection state is assumed is equal to the phase angle of backlash of the gear train between forward and reverse rotations of the 24 o'clock wheel. An electrically conductive contact spring is mounted to the 24 o'clock wheel. A circuit board is provided with electrical contacts disposed to come into contact with the contact spring when rotated. A 24 o'clock detection circuit is connectd to the electrical contacts to input an angular position detection signal indicating the angular position of the 24 o'clock wheel when the contact spring contacts a respective one of the electrical contacts. The electrical contacts include first and second contacts spaced from each other on the circuit board to come into contact with the contact spring at different times during rotation of the contact spring to produce angular position detection signals for detecting the angular position of the 24 o'clock wheel.

2 Claims, 9 Drawing Sheets

ELECTRONIC TIMEPIECE

BACKGROUND OF THE INVENTION

1. Field of the Invention

The present invention relates to control structure and a control method for an electronic timepiece having a 24 hour, or 24 o'clock angular position detection device for detecting the angular position of a 24 o'clock wheel contained in the front gear train in such an electronic timepiece.

2. Description of the prior Art

In the prior art electronic timepiece, as shown in FIG. 1, a part of a front gear train 101 (for example, a 24 o'clock wheel) has a 24 o'clock contact 102 for detecting the angular position of the front gear train 101. When the 24 o'clock contact 102 detects a position corresponding to 0 a.m., a detection signal produced by the 24 o'clock contact 102 causes a circuit block 103 to rotate a calender advance motor (referred to herein as a) day feed motor 104. When the day feed motor 104 rotates, a date indicator (referred to herein as a day wheel) 106 displays the day by means of rotating a reduction gear train 105.

In the prior art electronic timepiece, when the 24 o'clock detection position is placed in position by rotating the 24 o'clock wheel in a forward direction, if the 24 o'clock wheel is rotating forwardly, the position of the 24 o'clock indicated by a indicator agrees with the detected 24 o'clock position. However, if the 24 o'clock wheel is rotating in reverse, and if the time is reversed to correct the time, for example, backlash of the front gear train produces an error between the position of the 24 o'clock indicated by the indicator and the detected position of the 24 o'clock. Consequently, there arises the problem that 24 o'clock cannot be precisely detected at the position of the 24 o'clock indicated by the indicator.

Accordingly, it is an object of the present invention to provide an electronic timepiece h having a detector and detection control l capable of detecting 24 o'clock precisely, whether the rotation is forward or reverse, to solve the problems described above.

SUMMARY OF THE INVENTION

To solve the foregoing problems, the present invention provides an electronic timepiece comprising: a 24 o'clock wheel rotated by rotation of a gear train contained in the electronic timepiece; a contact spring fixedly mounted to the 24 o'clock wheel and rotating therewith, the spring having electrical conductivity; patterns for detection, the patterns being formed on a circuit board and capable of coming into contact with the contact spring when the contact spring rotates; and a 24 o'clock detection circuit for inputting an angular position detection signal that detects the angular position of the 24 o'clock wheel and is produced from the patterns for detection when the contact spring is in contact with the patterns for detection. The patterns for detection include first and second patterns for detection. The first and second patterns are formed on the circuit board and capable of coming into contact with the contact spring when the contact spring rotates. The contact spring and the first and second patterns for detection can assume a first detection state in which only the first pattern for detection produces an angular position detection signal for detecting the angular position of the 24 o'clock wheel, a second detection state in which only the second pattern for detection produces an angular position detection signal of r detecting the angular position of the 24 o'clock wheel, and a third detection state in which both first and second patterns for detection produce angular position detection signals for detecting the angular position of the 24 o'clock wheel. The phase angle of the 24 o'clock wheel that keeps producing the third detection state is set equal to the phase angle of backlash of a front gear train created between forward and reverse rotations of the 24 o'clock wheel.

The 24 o'clock detection circuit of the electronic timepiece in accordance with the present invention judges the direction of rotation of the 24 o'clock wheel as forward when the third detection state occurs immediately after detection of the first detection state and judges the direction of rotation of the 24 o'clock wheel as reverse when the third detection state occurs immediately after the second state is detected.

In this structure, the position of 24 o'clock indicated by the indicator, is made coincident with the detected position of 24 o'clock, whether the 24 o'clock wheel is rotating forwardly or rearwardly. In consequence, the position of 24 o'clock can be detected precisely.

BRIEF DESCRIPTION OF THE DRAWINGS

A preferred form of the present invention is illustrated in the accompanying drawings in which.

DETAILED DESCRIPTION OF THE PREFERRED EMBODIMENTS

Embodiments of the present invention are hereinafter described with reference to the drawings.

(1) Gear Train Structure

Figure 1:
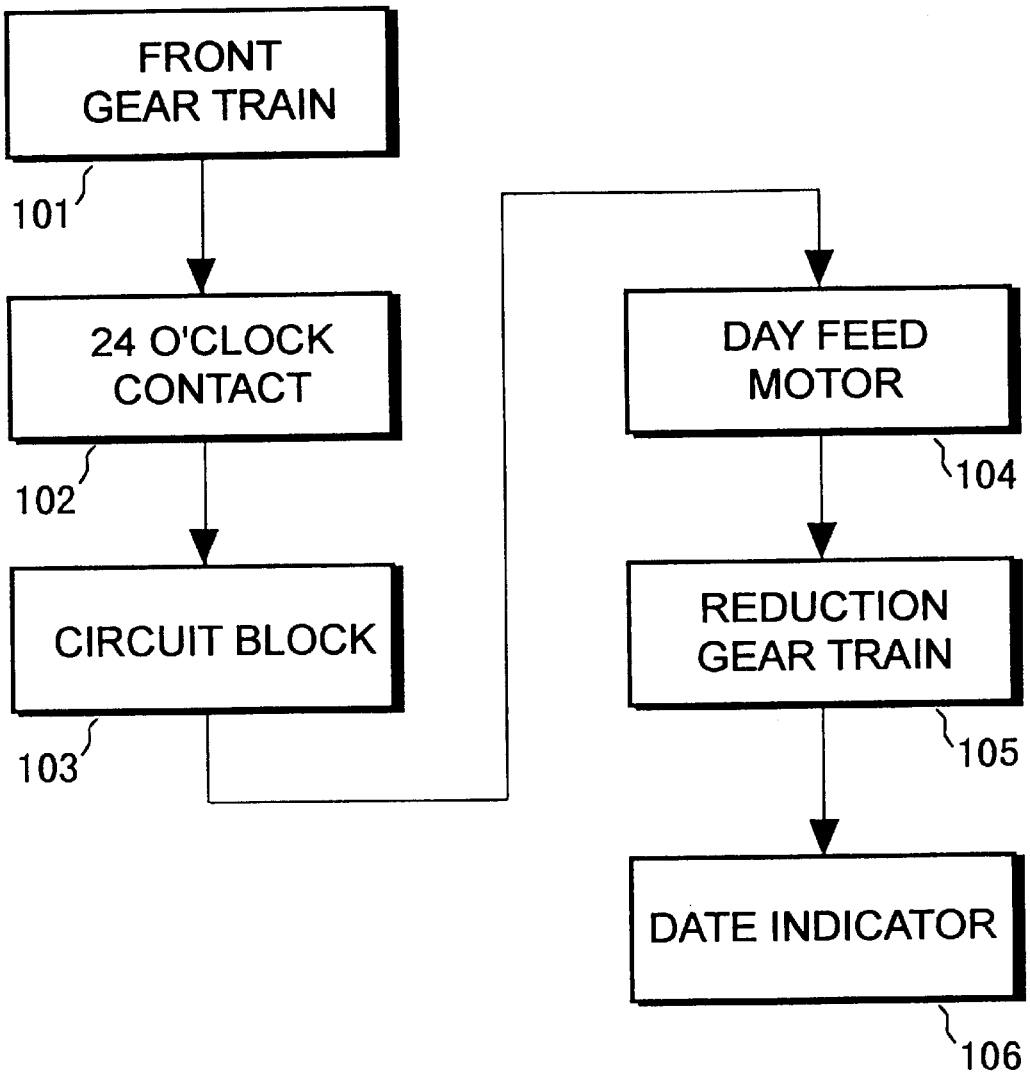
FIG. 1 is a schematic block diagram showing the structure of the prior art electronic timepiece.
Figure 2:
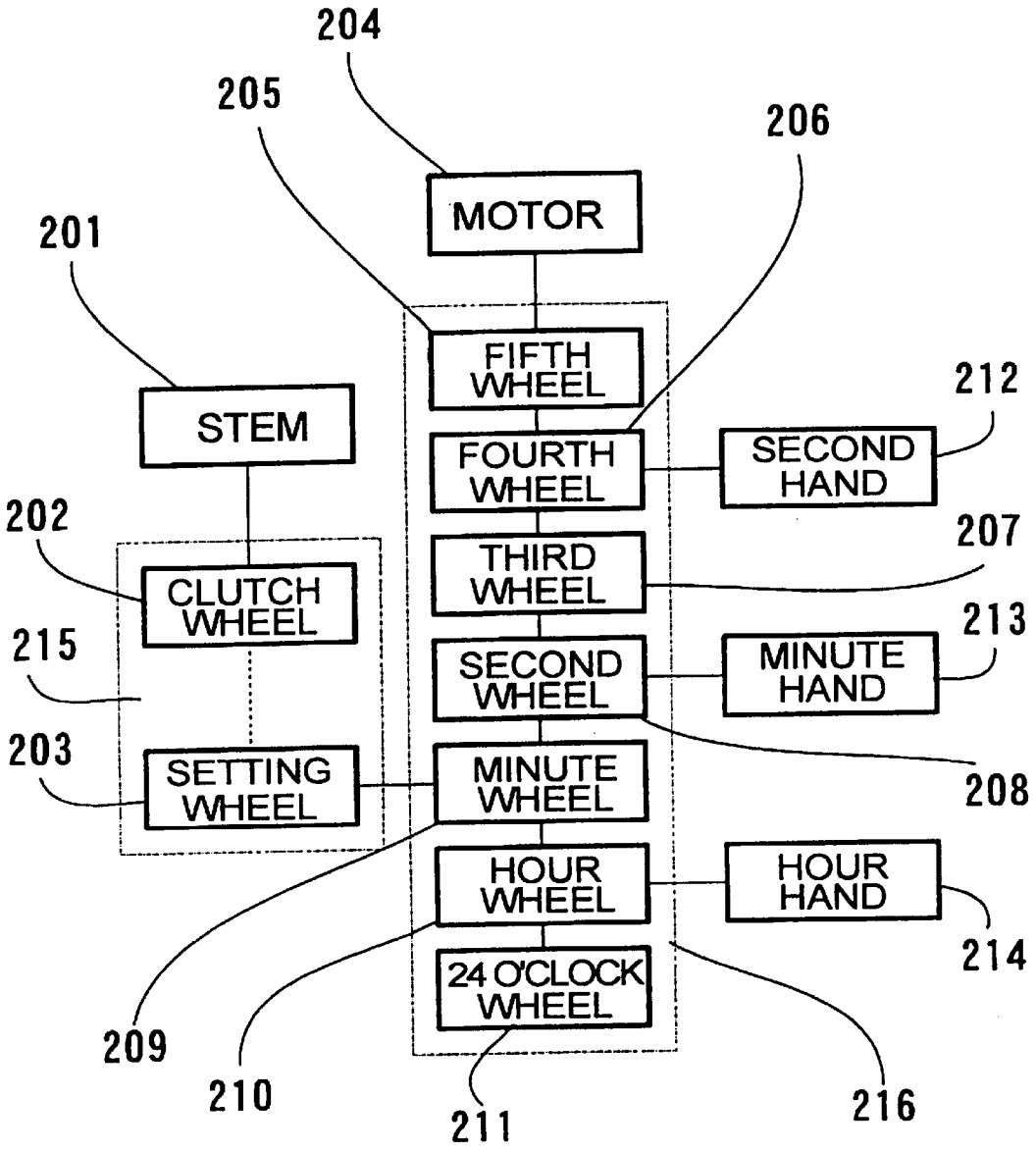
FIG. 2 is a schematic block diagram showing the gear train structure of an embodiment of an electronic timepiece in accordance with the invention.

FIG. 2 is a block diagram of a gear train structure representing one example of an electronic timepiece in accordance with the present invention. A motor 204 is driven by driving pulses produced, one per second, from a motor driver circuit (not shown).

The front gear train 216 is comprised of a fifth wheel 205, a fourth wheel 206, a third wheel 207, a second wheel 208, a day rear wheel 209, a cylindrical wheel 210, and a 24 o'clock wheel 211. A second hand 212 is fixed to the fourth wheel 206, a minute hand 213 is fixed to the second hand 208, and an hour hand 214 is fixed to the cylindrical wheel 210. Power produced from the motor 204 is reduced in speed and reaches the 24 o'clock wheel 211, which rotates one revolution a day. A stem 201 has two states: 0th state and 1st state in which the stem is pulled. In the 0th state, the time is displayed, and a clutch wheel 202 of the gear train for correcting time 215 is not in mesh with a setting wheel 203 of the gear train for correcting time 215. Therefore, the front gear train 216 is not affected. When the stem 201 is put in the 1st state in which the stem is pulled, the clutch wheel 202 of the gear train for correcting time 215 is in mesh with the setting wheel of the gear train for correcting time 215, whereby the time is corrected.

The gear train structure of this electronic timepiece is known and will not be described in detail. By rotating the stem 201 under this 1st state which the stem is pulled, the time can be corrected by rotation an hour hand 214 and a minute hand 213. The angular position of the 24 o'clock wheel 211 when the stem 201 is rotated in a forward direction and the hour hand 214 and the minute hand 213 are set for 24 o'clock is slightly deviated from the angular position of the 24 o'clock wheel 211 when the stem 201 is rotated in reverse and the hour hand 214 and the minute hand 213 are set for 24 o'clock due to backlash of the various wheels including a second wheel 208, a minute wheel 209, a hour wheel 210, and the 24 o'clock wheel 211.

It is assumed that the 24 o'clock wheel 211 produces a phase angle of about 15° between the forward and rearward rotations. An example of the contact mechanism is given below.

(2) Structure of Contact Mechanism

FIGS. 3–9 show a 24 o'clock detection mechanism in accordance with the present invention. In the electronic timepiece in accordance with the present invention, the contact spring 301 for detecting the position of 24 o'clock is mounted to the 24 o'clock wheel 211 of the front gear train 216. The contact spring 301 has three contact spring terminals 301*a*, 301*b*, and 301*c*.

Patterns (not shown) for the terminals of the contact spring 301 are formed on the circuit board 302, corresponding to the circumferential orbit traced by the front ends of the contact spring terminals 301*a*, 301*b*, and 301*c*. The contact spring 301 is so positioned that it can contact with the spring contact patterns (not shown) formed on the circuit board 302.

The 24 o'clock wheel 211 meshes with the hour wheel 210 and rotates one revolution a day. The hour wheel 210 rotates one revolution every 12 hours. An hour hand (not shown) attached to the hour wheel 21O shows "hour".

(3) Detailed Structure of Contact Portion

Figure 3:
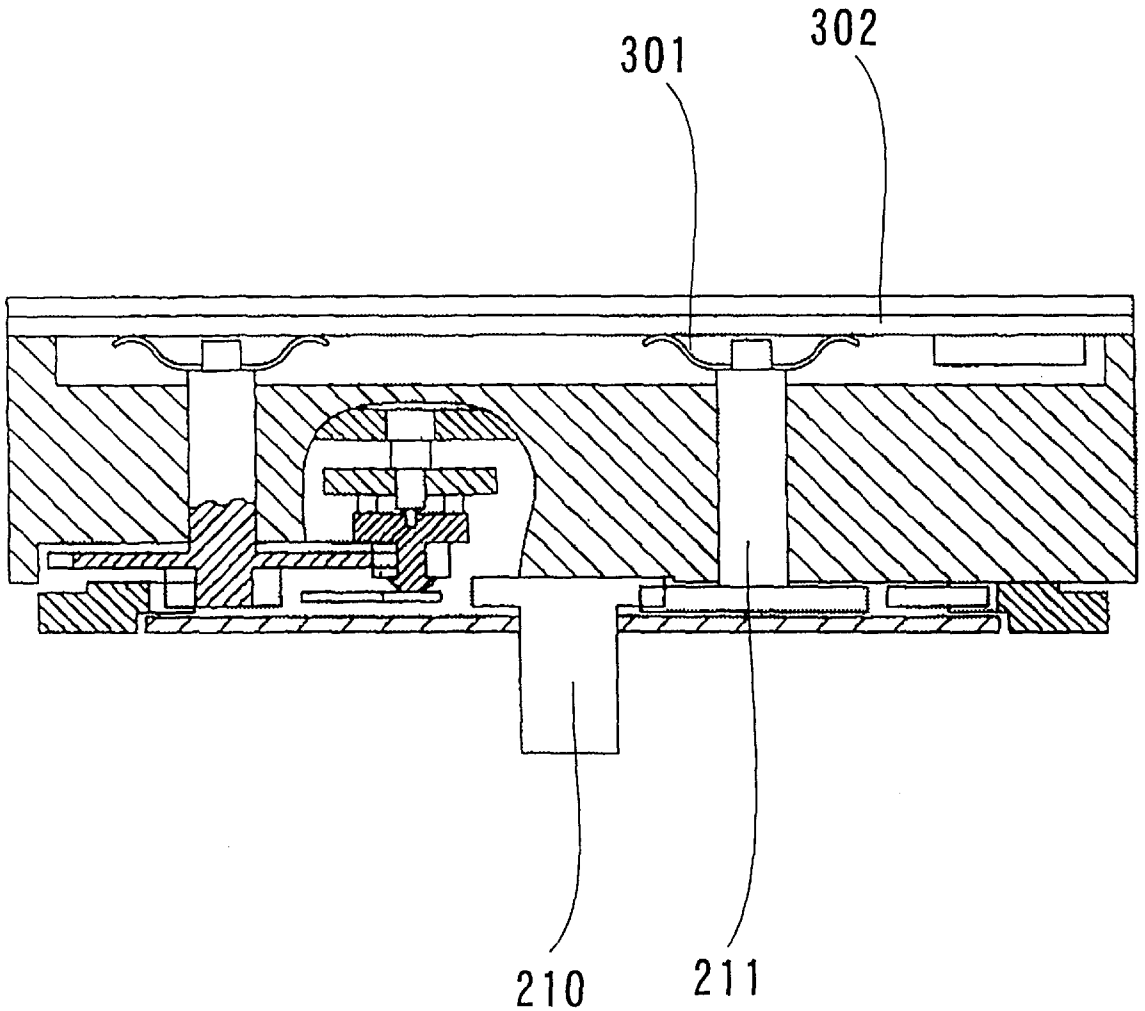
FIG. 3 is a schematic cross section showing the contact mechanism structure of one embodiment of an electronic timepiece in accordance with the invention.
Figure 4:
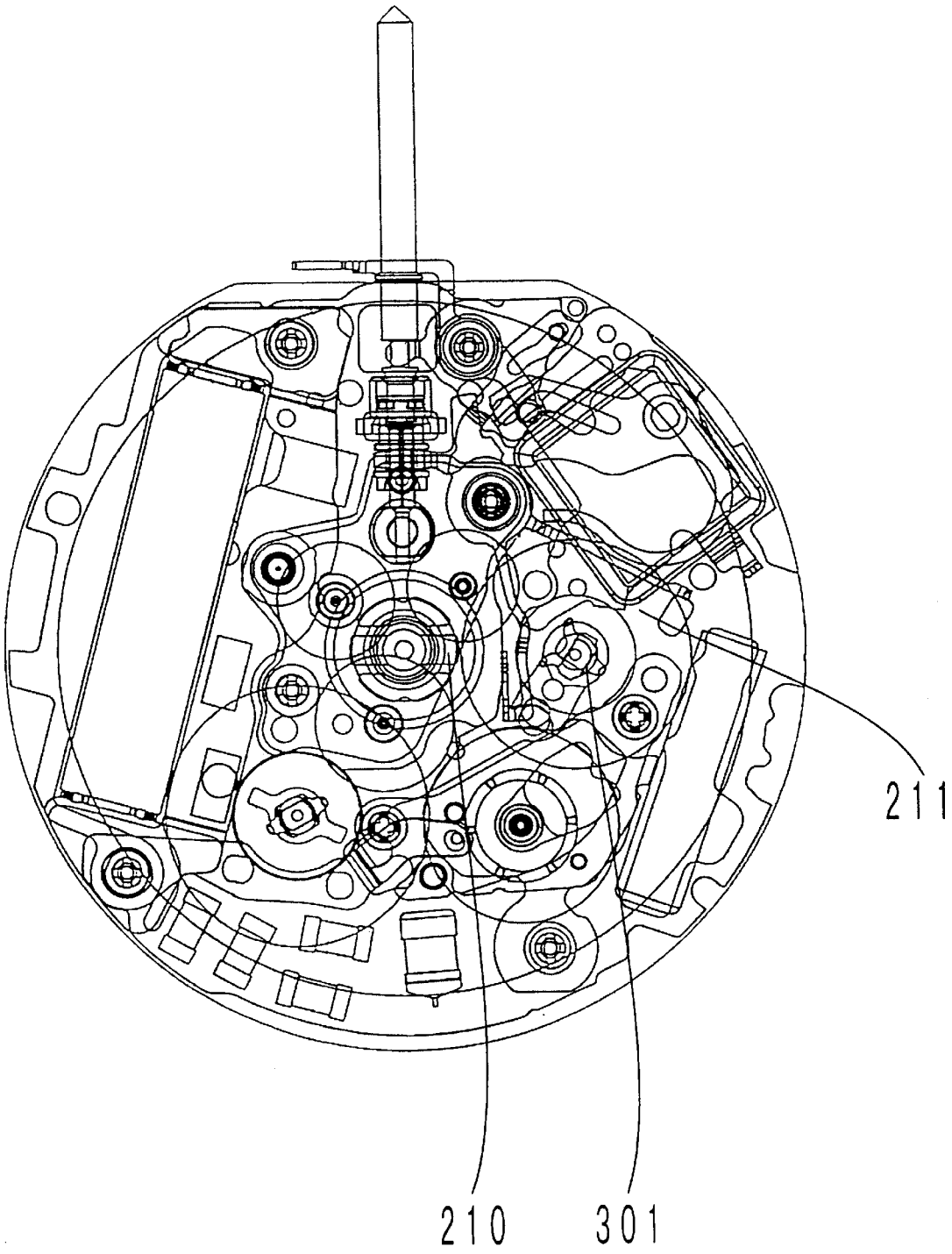
FIG. 4 is a schematic plan view (perspective view) showing the front side portion of one embodiment of an electronic timepiece in accordance with the invention.

Referring to FIGS. 3 and 4, the contact spring 301 is fixed to the 24 o'clock wheel 211. The contact spring 301 has electrical conductivity. For example, the contact spring 301 is made of a metal such as stainless steel. Alternatively, the surface of the contact spring 301 may be plated with gold.

Figure 5:
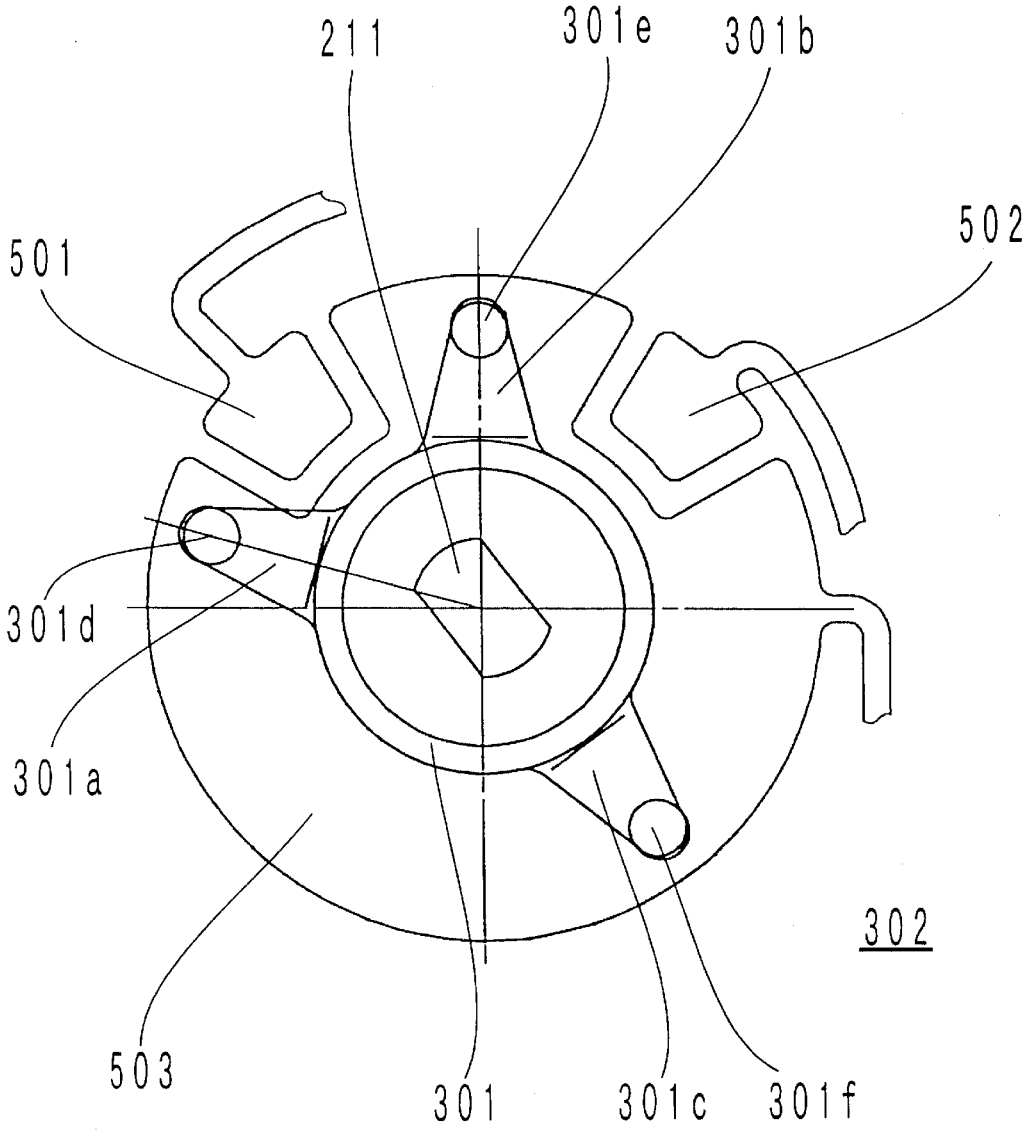
FIG. 5 is a partially plan view showing the contact portion of one embodiment of an electronic timepiece in accordance with the invention.

Referring to FIG. 5, A pattern 501, B pattern 502, and a VDD pattern 503 are formed on the surface of the circuit board 302. The A pattern 501 and the B pattern 502 are connected with the 24 o'clock detection circuit (not shown). The VDD pattern 503 may be connected directly with the positive side (VDD) of the power supply, or connected with the 24 o'clock detection circuit (not shown) in which the pattern is connected with the positive side (VDD) of the power supply.

When the A pattern 501 is electrically connected with the positive side (VDD) of the power supply, an A pattern detection signal that is a first detection signal is applied to the 24 o'clock detection circuit (not shown). That is, in this case, the A pattern input terminal of the 24 o'clock detection circuit goes to "1", or "high".

When the B pattern 502 is connected with the positive side (VDD) of the power supply, a B pattern detection signal that is a second detection signal is applied to the 24 o'clock detection circuit (not shown). That is, in this case, the B pattern input terminal of the 24 o'clock detection circuit goes to "1", or "high".

Figure 7:
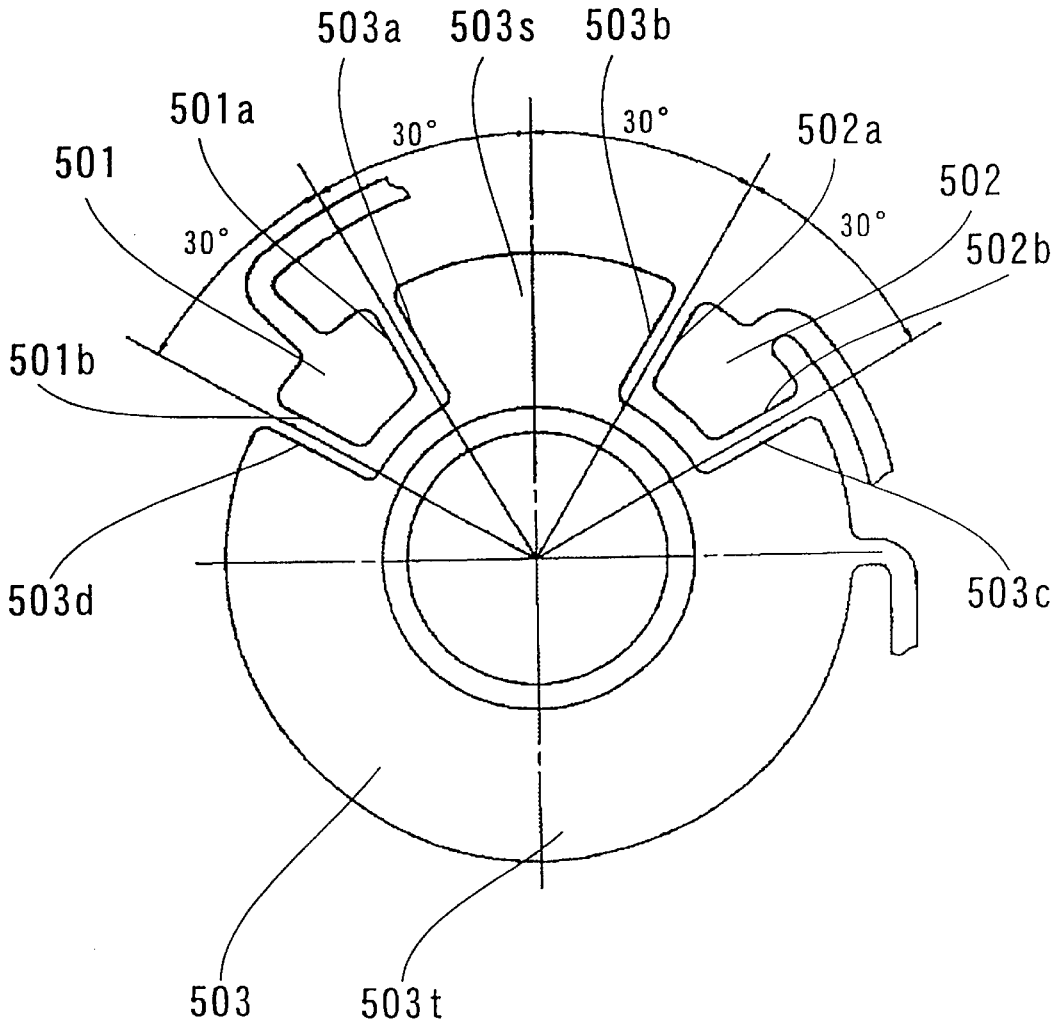
FIG. 7 is a partially plan view showing the structure of a circuit pattern of a contact mechanism of one embodiment of an electronic timepiece in accordance with the invention.

Referring to FIG. 7, the patterns are described in the clockwise order.

The A pattern 501 extends about 30° about the center of rotation of the 24 o'clock wheel 211. The A pattern 501 has a first peripheral end portion 501*a* and a second peripheral end portion 501*b*.

The VDD pattern 503 has a first pattern portion 503*s* and a second pattern portion 503*t*. The first pattern portion 503*s* of the VDD pattern 503 has a first peripheral end portion 503*a* and a second peripheral end portion 503*b*. The first end portion 503*a* of the VDD pattern 503 is adjacent to the first end portion 501*a* of the A pattern 501 via a gap. The first pattern portion 503*s* of the VDD pattern 503 extends about 60° about the center of rotation of the 24 o'clock wheel 211. The B pattern 502 has a first peripheral end portion 502*a* and a second peripheral end portion 502*b*. The first end portion 502*a* of the B pattern 502 is adjacent to the second end portion 503*b* of the first pattern portion 503*s* of the VDD pattern 503 via a gap. The B pattern 502 extends about 30° about the center of rotation of the 24 o'clock wheel 211.

The second end portion 502*b* of the B pattern 502 is adjacent to the first end portion 503*c* of the second pattern portion 503*t* of the VDD pattern 503 via a gap. The second pattern portion 503*t* of the VDD pattern 503 extends about 240° about the center of rotation of the 24 o'clock wheel 211. The second end portion 503*d* of the second pattern portion 503*t* of the VDD pattern 503 is adjacent to the second end portion 501*b* of the A pattern 501 via a gap.

As described above, the A pattern 501, the first pattern portion 503*s* of the VDD pattern 503, the B pattern 502, and the second pattern portion 503*t* of the VDD pattern 503 are circumferentially formed about the center of rotation of the 24 o'clock wheel 211 in a clockwise direction on the surface of the circuit board 302.

Figure 6:
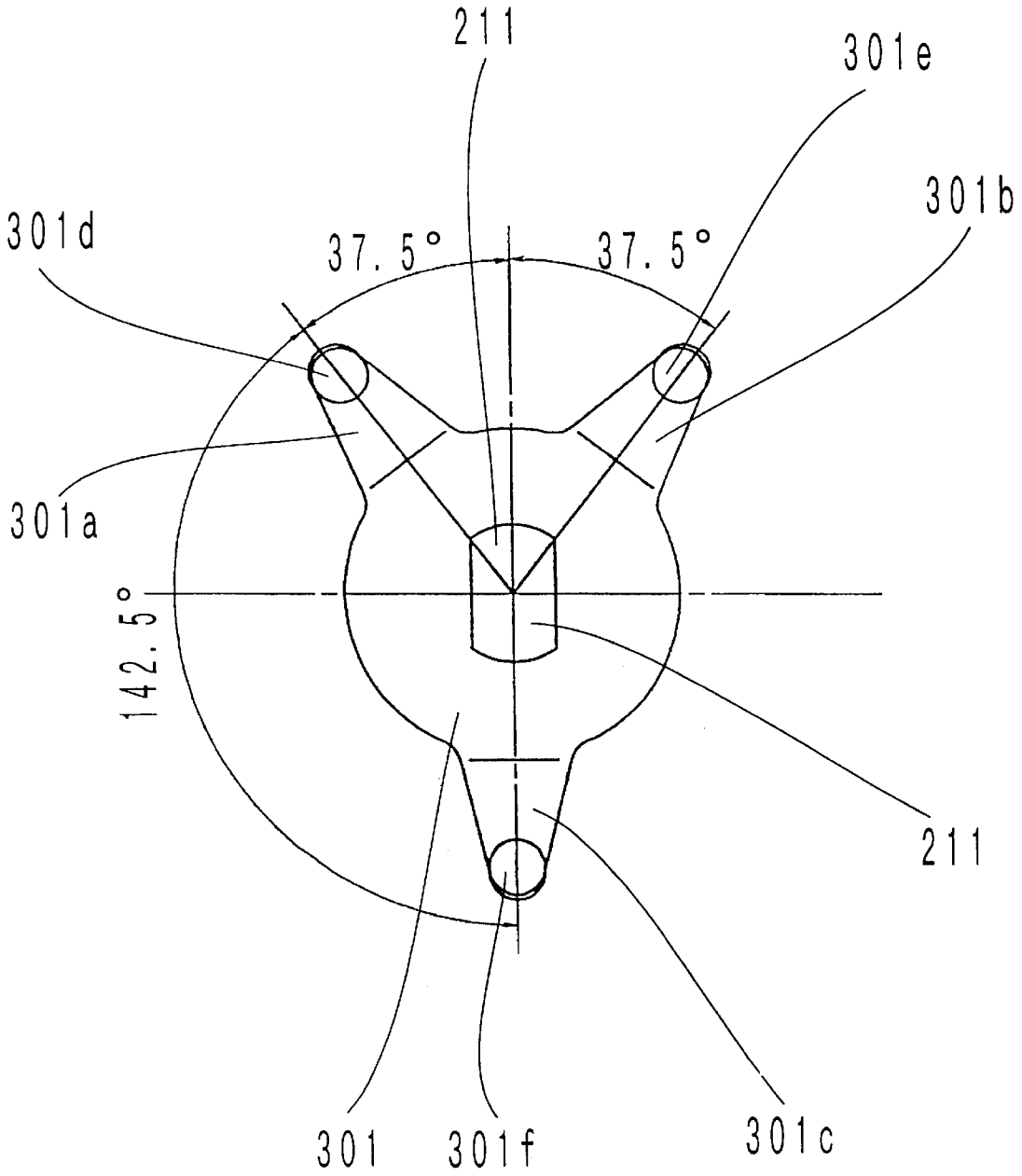
FIG. 6 is a partially plan view showing the shape of a contact spring of a contact mechanism of one embodiment of an electronic timepiece in accordance with the invention.

Referring to FIG. 6, the contact spring 301 has three contact spring terminals 301*a*, 301*b*, and 301*c* extending outwardly about the center of rotation of the 24 o'clock wheel 211. The contact spring terminals 301*a* and 301*b* form angles of approximately 75°. The contact spring terminals 301*a* and 301*c* make angles of about 142.5°. The contact spring terminals 301*b* and 301*c* make angles of about 142.5°.

A terminal contact portion 301*d* is formed in a front end portion of the contact spring terminal 301*a*. A terminal contact portion 301*e* is formed in a front end portion of the contact spring terminal 301*b*. A terminal contact portion 301*f* is formed in a front end portion of the contact spring terminal 301*c*.

When the 24 o'clock wheel 211 turns, the terminal contact portions 301*d*, 301*e*, and 301*f* come into contact with the A pattern 501, the first pattern portion 503*s* of the VDD pattern 503, the B pattern 502, and the second pattern portion 503*t* of the VDD pattern 503, respectively.

When the 24 o'clock wheel 211 rotates in a clockwise direction, or in the forward direction, the direction of rotation is detected in the manner described below. Also, an operation for detecting the 24 o'clock position is described.

1) Operative State 1

Figure 8:
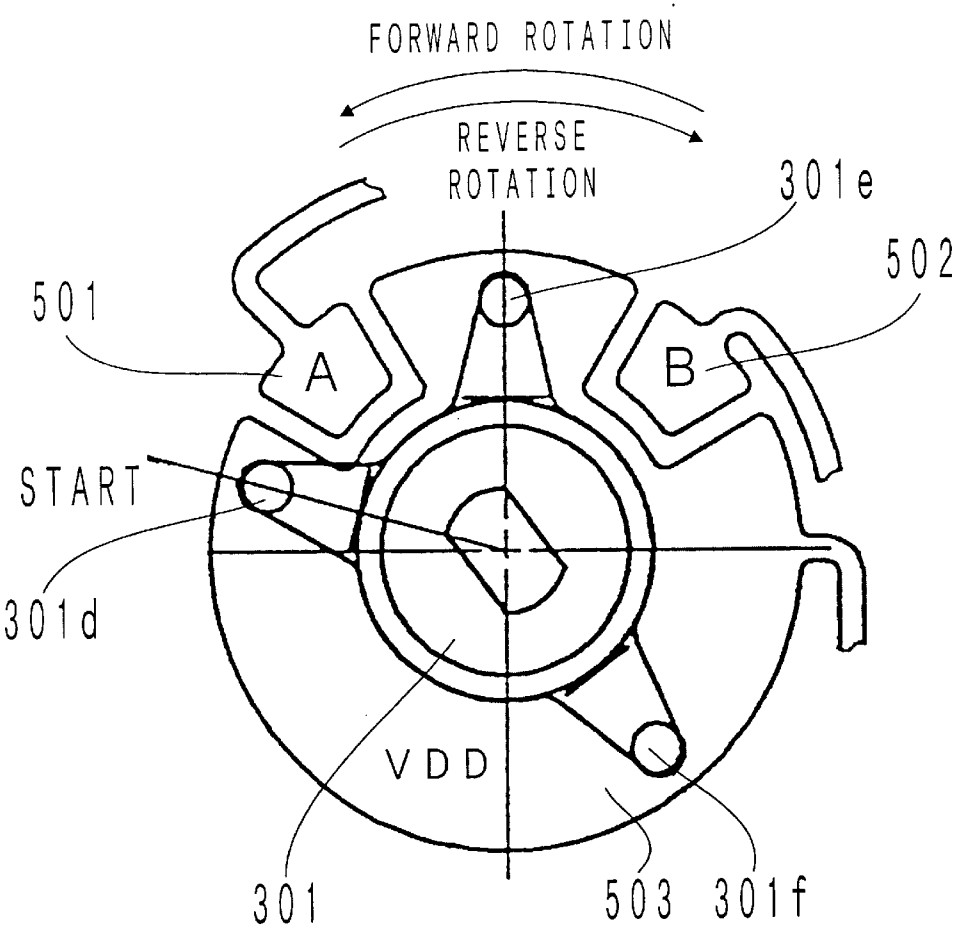
FIG. 8 is a partially plan view showing the operation of the contact mechanism of one embodiment of an electronic timepiece in accordance with the invention.

FIG. 8 shows the initial state of the 24 o'clock wheel 211. That is, the terminal contact portion 301 d of the contact spring 301 is in its start position, producing operative state 1. This state 1 is indicated by "0°" in the timing chart of forward rotation of FIG. 9.

In the operative state 1 shown in FIG. 8, the terminal contact portions 301*d*, 301*e*, and 301*f* are all in contact with the VDD pattern.

In this operative state 1, neither the A pattern detection signal nor the B pattern detection signal is applied to the 24 o'clock detection circuit (not shown). That is, in this operative state 1, the A pattern input terminal and the B pattern input terminal of the 24 o'clock detection circuit are in "0", or "low" state.

2) Operative State 2

Then, the terminal contact portion 301 d of the contact spring 301 rotates through about 15° from the start position in a clockwise direction, producing operative state 2. In this state, the terminal contact portion 301*d* is in contact with the A pattern 501. The terminal contact portions 301*e* and 301*f* are in contact with the VDD.

In this operative state 2, only the A pattern detection signal is applied to the 24 o'clock detection circuit (not shown). That is, in this operative state 2, the A pattern input terminal of the 24 o'clock detection circuit goes to "1", or "high". The B pattern input terminal remains at "0", or "low".

3) Operative State 3

Then, the terminal contact portion 301*d* of the contact spring 301 is rotated through about 30° from the start position in a clockwise direction, producing operative state 3. In this state, the terminal contact portion 301*d* is in contact with the A pattern 501. The terminal contact portion 301*e* is in contact with the B pattern 502. The terminal contact portion 301*f* is in contact with the VDD pattern 503.

In this operative state 3, both A pattern detection signal and B pattern detection signal are applied to the 24 o'clock detection circuit (not shown). In this operative state 3, the A pattern input terminal of the 24 o'clock detection circuit is at "1", or "high". The B pattern input signal is also at "1", or "high".

4) Operative State 4

Then, the terminal contact portion 301*d* of the contact spring 301 is rotated through about 45° from the start position in a clockwise direction, producing operative state 4. In this state, the terminal contact portions 301*d* and 301*f* are in contact with the VDD pattern 503. The terminal contact portion 301*e* is in contact with the B pattern 502.

In this operative state 4, only the B pattern detection signal is applied to the 24 o'clock detection circuit (not shown). That is, the A pattern input terminal of the 24 o'clock detection signal is at "0", or "low". The B pattern input terminal remains at "1", or "high".

Figure 9:
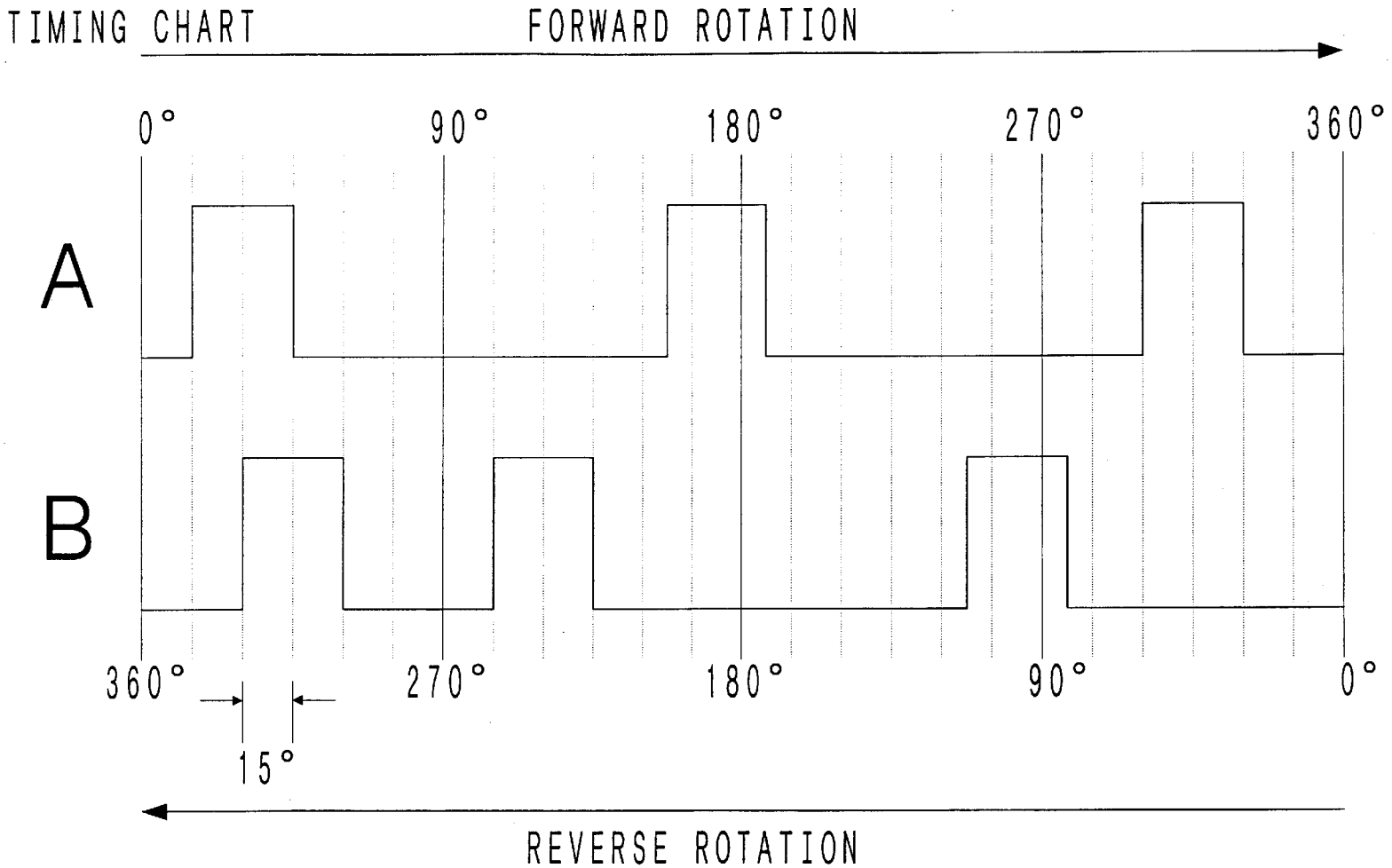
FIG. 9 is a timing chart when the contact mechanism of one embodiment of an electronic timepiece in accordance with the invention is in operation.

Therefore, as shown in FIG. 9, when both A and B pattern input terminals of the 24 o'clock detection circuit are at "1", the position is about 15°.

5) Operative State 5

Then, the terminal contact portion 301*d* of the contact spring 301 is rotated through about 60° from the start position in a clockwise direction, producing operative state 5. In this state, the terminal contact portions 301*d*, 301*e*, and 301*f* are all in contact with the VDD pattern 503.

In this operative state 5, neither the A pattern detection signal nor the B pattern detection signal is applied to the 24 o'clock detection circuit (not shown). That is, in this operative state 5, both A and B pattern input terminals of the 24 o'clock detection circuit are at "0", or "low".

6) Operative State 6

Then, the terminal contact portion 301*d* of the contact spring 301 is rotated through about 105° from the start position in a clockwise direction, producing operative state 6. In this state, the terminal contact portion 301*d* is in contact with the B pattern 502. The terminal contact portions 301*e* and 301*f* are in contact with the VDD pattern 503.

In this operative state 6, only the B pattern detection signal is applied to the 24 o'clock detection circuit (not shown). That is, in this operative state 6, the A pattern input terminal of the 24 o'clock detection circuit remains at "0". The B pattern input terminal goes to "1", or "high".

7) Operative State 7

Then, the terminal contact portion 301*d* of the contact spring 301 rotates through about 135° from the start position in a clockwise direction, producing operative state 7. The terminal contact portions 301*d*, 301*e*, and 301*f* are all in contact with the VDD patterns 503.

In this operative state 7, neither the A pattern detection signal nor the B pattern detection signal is applied to the 24 o'clock detection circuit (not shown). That is, in this operative state 7, both A and B pattern input terminals of the 24 o'clock detection circuit are at "0", or "low".

8) Operative State 8

Then, the terminal contact portion 301*d* of the contact spring 301 rotates through about 157.5° from the start position in a clockwise direction, producing operative state 8. In this state, both terminal contact portions 301*d* and 301*e* are in contact with the VDD pattern 503. The terminal contact portion 301*f* is in contact with the A pattern 501.

In this operative state 8, only the A pattern detection signal is applied to the 24 o'clock detection circuit (not shown). That is, in this operative state 8, the A pattern input terminal of the 24 o'clock detection circuit is at "1", or "high". The B pattern input terminal remains at "0", or "low".

9) Operative State 9

Then, the terminal contact portion 301*d* of the contact spring 301 is rotated through about 187.5° from the start position in a clockwise direction, producing operative state 9. In this state, the terminal contact portions 301*d*, 301*e*, and 301*f* are all in contact with the VDD pattern 503. In this operative state 9, neither the A pattern detection signal nor the B pattern detection signal is applied to the 24 o'clock detection circuit (not shown). That is, in this operative state 9, both A and B pattern input terminals are at "0", or "low".

10) Operative State 10

Then, the terminal contact portion 301*d* of the contact spring 301 is rotated through about 247.5° from the start position in a clockwise direction, producing operative state 10. In this state, the terminal contact portions 301*d* and 301*e* are in contact with the VDD pattern 503. The terminal contact portion 301*f* is in contact with the B pattern 502.

In this operative state 10, only the B pattern detection signal is applied to the 24 o'clock detection circuit (not shown). That is, in this operative state 10, the A pattern input terminal of the 24 o'clock detection circuit remains at "0". The B pattern input terminal goes to "1", or "high".

11) Operative State 11

Then, the terminal contact portion 301*d* of the contact spring 301 is rotated through about 277.5° from the start position in a clockwise direction, thus producing operative state 11. In this state 11, the terminal contact portions 301*d*, 301*e*, and 301*f* are in contact with the VDD pattern 503.

In this operative state 11, neither the A pattern detection signal nor the B pattern detection signal is applied to the 24 o'clock detection circuit (not shown). That is, in this operative state 11, both A and B pattern input terminals of the 24 o'clock detection circuit are at "0", or "low".

12) Operative State 12

Then, the terminal contact portion 301*d* of the contact spring 301 is rotated through about 300° from the start position in a clockwise direction, producing operative state 12. In this state 12, both terminal contact portions 301*d* and 30if are in contact with the VDD pattern 503. The terminal contact portion 301*e* is in contact with the A pattern 501.

In this operative state 12, only the A pattern detection signal is applied to the 24 o'clock detection circuit (not shown). That is, in this operative state 12, the A pattern input terminal of the 24 o'clock detection circuit is at "1", or "high". The B pattern input terminal remains at "0", or "low".

13) Operative State 13

Then, the terminal contact portion 301*d* of the contact spring 301 is rotated through about 330° from the start position in a clockwise direction, thus producing operative state 13. In this state 13, the terminal contact portions 301*d*, 301*e*, and 301*f* are all in contact with the VDD pattern 503.

In this operative state 13, neither the A pattern detection signal nor the B pattern detection signal is applied to the 24 o'clock detection circuit (not shown). That is, in this operative state 13, both A and B pattern input terminals of the 24 o'clock detection circuit are at "0", or "low".

14) Operation for Return to Starting State

If the terminal contact portion 301*d* of the contact spring 301 rotates through 360° from the start position in a clockwise direction, it goes back to the starting state shown in FIG. 8.

In this structure, when the 24 o'clock wheel 211 makes one revolution, the A pattern input terminal and the B pattern input terminal of the 24 o'clock detection circuit go to "1" for about 15°. Before the A and B pattern input terminals go to "1", the A pattern input terminal goes to "1". Thus, forward rotation can be judged. At the same time, both A and B pattern input terminals go to "1". In this way, the position of 24 o'clock during the forward rotation of the 24 o'clock wheel 211 can be detected.

Detection of the direction of rotation when the 24 o'clock wheel 211 rotates in a counterclockwise direction, i.e., when it is reversed, and an operation for the detection of the 24 o'clock position are described below.

Since the operation of the contact spring 301 is rotary motion in a plane, the angular position of the contact spring when the terminal contact portion 301*d* rotates from the start position to the position of X° in a clockwise direction is identical with the angular position of the contact spring when the terminal contact portion 301*d* rotates from the start position to the position of (360-X)° in a counterclockwise direction. Take an example. The angular position of the contact spring when the terminal contact portion 301*d* rotates from the start position to the position of 270° in a clockwise direction is identical with the angular position of the contact spring when the terminal contact portion 301*d* rotates from the start position to the position of 90° in a counterclockwise direction.

Accordingly, with respect to the reverse rotation, only variations in the levels at the A pattern input terminal and the B pattern input terminal are described.

1) Operative State 1

FIG. 8 shows the initial state of the 24 o'clock wheel 211. That is, this is the operative state 1, in which the terminal contact portion 301*d* of the contact spring 301 is at the start position. This state 1 is indicated by "0°" in the timing chart of reverse rotation of FIG. 9.

In this operative state 1, neither A pattern detection signal nor the B pattern detection signal is applied to the 24 o'clock detection circuit (not shown). That is, in this operative state 1, both A pattern input terminal and B pattern input terminal of the 24 o'clock detection circuit are at "0", or "low".

2) Operative State 2

In the operative state 2, the terminal contact portion 301*d* of the contact spring 301 has rotated from the start position to the position of about 30° in a counterclockwise direction. In this operative state 2, only the A pattern detection signal is applied to the 24 o'clock detection circuit (not shown). That is, in this operative state 2, the A pattern input terminal of the 24 o'clock detection circuit goes to "1", or "high". The B pattern input terminal remains at "0", or "low".

3) Operative State 3

In the operative state 3, the terminal contact portion 301*d* of the contact spring 301 has rotated from the start position to the position of about 60° in a counterclockwise direction. In this state, neither the A pattern detection signal nor the B pattern detection signal is applied to the 24 o'clock detection circuit (not shown). That is, in this operative state 3, both A and B pattern input terminals of the 24 o'clock detection circuit are at "0", or "low".

4) Operative State 4

In the operative state 4, the terminal contact portion 301*d* of the contact spring 301 has rotated from the start position to the position of about 82.5° in a counterclockwise direction. In this operative state 4, only the B pattern detection signal is applied to the 24 o'clock detection circuit (not shown). That is, in this operative state 4, the A pattern input terminal of the 24 o'clock detection circuit remains at "0". The B pattern input terminal goes to "1", or "high".

5) Operative State 5

In the operative state 5, the terminal contact portion 301*d* of the contact spring 301 has rotated from the start position to the position of about 112.5° in a counterclockwise direction. In this state 5, neither the A pattern detection signal nor the B pattern detection signal is applied to the 24 o'clock detection circuit (not shown). That is, in this operative state 5, both A and B pattern input terminals of the 24 o'clock detection circuit are at "0", or "low".

6) Operative State 6

In the operative state 6, the terminal contact portion 301*d* of the contact spring 301 has rotated from the start position to the position of about 172.5° in a counterclockwise direction. In this operative state 6, only the A pattern detection signal is applied to the 24 o'clock detection signal (not shown). That is, in this operative state 6, the A pattern input terminal of the 24 o'clock detection circuit goes to "1", or "high". The B pattern input terminal remains at "0", or "low".

7) Operative State 7

In the operative state 7, the terminal contact portion 301*d* of the contact spring 301 has rotated from the start position to the position of about 202.5° in a counterclockwise direction. In this operative state 7, neither the A pattern detection signal nor the B pattern detection signal is applied to the 24 o'clock detection circuit (not shown). That is, in this operative state 7, both A and B pattern input terminals of the 24 o'clock detection circuit are at "0", or "low".

8) Operative State 8

In the operative state 8, the terminal contact portion 301*d* of the contact spring 301 has rotated from the start position to the position of about 225° in a counterclockwise direction. In this state 8, only the B pattern detection signal is applied to the 24 o'clock detection circuit (not shown). That is, in this operative state 8, the A pattern input terminal of the 24 o'clock detection circuit remains at "0". The B pattern input terminal goes to "1", or "high".

9) Operative State 9

In the operative state 9, the terminal contact portion 301*d* of the contact spring 301 has rotated from the start position to the position of about 255° in a counterclockwise direction. In this operative state 9, neither the A pattern detection signal nor the B pattern detection signal is applied to the 24 o'clock detection circuit (not shown). That is, in this operative state 9, both A and B pattern input terminals of the 24 o'clock detection circuit are at "0", or "low".

10) Operative state 10

In the operative state 10, the terminal contact portion 301*d* of the contact spring 301 has rotated from the start position to the position of about 300° in a counterclockwise direction. In this state 10, only the B pattern detection signal is applied to the 24 o'clock detection circuit (not shown). That is, in this operative state 10, the A pattern input terminal of the 24 o'clock detection signal remains at "0", or "low". The B pattern input terminal goes to "1", or "high".

11) Operative State 11

In the operative state 11, the terminal contact portion 301*d* of the contact spring 301 has rotated from the start position to the position of about 315° in a counterclockwise direction. In this state 11, both A pattern detection signal and B pattern detection signal are applied to the 24 o'clock detection circuit (not shown). That is, in this operative state 11, the A pattern input terminal of the 24 o'clock detection circuit goes to "1", or "high". The B pattern input terminal remains at "1", or "high".

12) Operative State 12

In the operative state 12, the terminal contact portion 301*d* of the contact spring 301 has rotated from the start position to the position of about 330° in a counterclockwise direction. In this state 12, only the A pattern detection signal is applied to the 24 o'clock detection circuit (not shown). That is, in this operative state 12, the A pattern input terminal of the 24 o'clock detection circuit remains at "1", or "high". The B pattern input terminal goes to "0", or "low".

13) Operative State 13

In the operative state 13, the terminal contact portion 301*d* of the contact spring 301 has rotated from the start position to the position of about 345° in a counterclockwise direction. In this state 13, neither the A pattern detection signal nor the B pattern detection signal is applied to the 24 o'clock detection circuit(not shown). That is, in this operative state 13, both A and B pattern input terminals of the 24 o'clock detection circuit are at "0", or "low".

14) Operation for Return to Starting State

When the terminal contact portion 301*d* of the contact spring 301 rotates from the start position to the position of 360° in a counterclockwise direction, it returns to the starting state shown in FIG. 8.

In this structure, when the 24 o'clock wheel 211 makes one revolution, the A pattern input terminal and the B pattern input terminal on the 24 o'clock detection circuit once go to "1" for about 15°. Before the A and B pattern input terminals go to "1", the B pattern input terminal goes to "1". Thus, reverse rotation can be judged. At the same time, both A and B pattern input terminals go to "1". In this way, the position of 24 o'clock during the reverse rotation of the 24 o'clock wheel 211 can be detected.

Therefore, by adopting the structure of the contact mechanism and the 24 o'clock detection method as described above, a phase difference of about 15° is produced between the 24 o'clock position detection position in the forward direction and the 24 o'clock position detection position in the reverse direction. In consequence, the amount of deviation of phase angle due to backlash of the gear train can be corrected. The position of the 24 o'clock can be detected precisely.

In this example, the phase angle due to backlash of the gear train is set to about 15°. Various phase angles can be corrected by making fine adjustments of the aperture angles of the contact spring terminals 301*a* and 301*b* and fine adjustments of the peripheral pattern widths of the A pattern 501 and the B pattern 502.

[Effects of the Invention]

As described thus far, the present invention provides an electronic timepiece having a 24 o'clock detection device for detecting the direction of rotation and angular position of a 24 o'clock wheel. Therefore, the following advantages can be had.

(1) The direction of rotation and the position of the 24 o'clock wheel can be detected with a simple structure.

(2) The position of 24 o'clock can be detected precisely at the 24 o'clock position indicated by a indicator, whether the 24 o'clock wheel is rotating forwardly or reversely.

What is claimed is:

1. An electronic timepiece comprising:

a motor-driven gear train comprising a plurality of intermeshed gears including a 24 o'clock wheel which is driven to undergo one complete revolution each 24 hour period;

one or more indicating members driven by the gear train for indicating current time;

a contact spring fixedly mounted to the 24 o'clock wheel to undergo rotational movement therewith, the contact spring having an electrically conductive portion;

a circuit board having a plurality of angularly spaced-apart electrical contacts formed thereon, respective ones of the electrical contacts being disposed to come into contact with the electrically conductive portion of the contact spring during rotational movement of the contact spring;

a 24 o'clock detection circuit connected to the plurality of electrical contacts for inputting an angular position detection signal that indicates the angular position of the 24 o'clock wheel when the electrically conductive portion of the contact spring contacts a respective one of the electrical contacts;

wherein the electrical contacts include first and second electrical contacts formed angularly spaced apart from each other about a center of rotation of the contact spring on the circuit board and being disposed to come into contact with the electrically conductive portion of the contact spring at different times during rotational movement of the contact spring;

wherein the contact spring and the first and second electrical contacts are operable to assume a first detection state in which the electrically conductive portion of the contact spring is in contact with the first electrical contact to produce an angular position detection signal for detecting the angular position of the 24 o'clock wheel, a second detection state in which the electrically conductive portion of the contact spring is in contact with the second electrical contact to produce an angular position detection signal for detecting the angular position of the 24 o'clock wheel, and a third detection state in which the electrically conductive portion of the contact spring is in contact with both the first and second electrical contacts to produce angular position detection signals for detecting the angular position of the 24 o'clock wheel; and wherein a phase angle range of the 24 o'clock wheel at which the third detection state is assumed is set to be equal to the phase angle of backlash of the gear train created between forward and reverse rotations of the 24 o'clock wheel.

2. The electronic timepiece of claim 1; wherein the 24 o'clock detection circuit judges the direction of rotation of the 24 o'clock wheel as forward when the third detection state follows directly after detection of the first detection state and judges the direction of rotation of the 24 o'clock wheel as reverse when the third detection state follows directly after detection of the second detection state.

* * * * *